US010602810B2

(12) United States Patent
Hsu et al.

(10) Patent No.: US 10,602,810 B2
(45) Date of Patent: Mar. 31, 2020

(54) SLIDER FOR SLIDE FASTENER

(71) Applicant: YKK Corporation, Tokyo (JP)

(72) Inventors: Hsien Hsiang Hsu, Taipei (TW); Shinya Honda, Taipei (TW)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/001,900

(22) Filed: Jun. 6, 2018

(65) Prior Publication Data

US 2018/0360171 A1 Dec. 20, 2018

(30) Foreign Application Priority Data

Jun. 16, 2017 (CN) ..... 2017 2 0701062 U

(51) Int. Cl.
*A44B 19/26* (2006.01)

(52) U.S. Cl.
CPC ..... *A44B 19/262* (2013.01)

(58) Field of Classification Search
CPC ..... A44B 19/262
See application file for complete search history.

(56) References Cited

U.S. PATENT DOCUMENTS 2,373,523 A * 4/1945 Winterhalter ..... A44B 19/30 24/421
4,389,758 A * 6/1983 Akashi ..... A44B 19/262 24/429
4,949,434 A * 8/1990 Minami ..... A44B 19/262 24/429
4,982,479 A * 1/1991 Oda ..... A44B 19/26 24/419
4,985,969 A 1/1991 Terada et al.
5,086,546 A * 2/1992 Aoki ..... A44B 19/26 24/429

(Continued)

FOREIGN PATENT DOCUMENTS

JP 2007-054176 A 3/2007
KR 1991-0005337 B1 7/1991

(Continued)

OTHER PUBLICATIONS

Office Action, Korean Patent Application No. 20-2018-0002628, dated Feb. 28, 2019.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

There is provided a slider for a slide fastener. A pull-tab attachment portion is provided on a slider body portion. A pull-tab is attached on the pull-tab attachment portion. The pull-tab has a handle portion and a connection portion connected to the pull-tab attachment portion. The connection portion includes a shaft portion and a pair of rod portions made of metal and extending from both ends of the shaft portion toward the handle portion. The shaft portion has a core portion made of metal and a resin portion made of resin and covering at least a part of a circumference of the core portion. At least a part of an outer circumferential surface of the resin portion is in contact with an inner circumferential surface of the pull-tab attachment portion.

5 Claims, 8 Drawing Sheets

(56) References Cited

U.S. PATENT DOCUMENTS 5,419,019 A * 5/1995 Ida ..... A44B 19/306 24/421
5,621,954 A * 4/1997 Mizuno ..... A44B 19/26 24/429
5,848,455 A * 12/1998 Ikehara ..... A44B 19/306 24/422
6,009,602 A * 1/2000 Terada ..... A44B 19/306 24/433
6,332,249 B1 * 12/2001 Oda ..... A44B 19/303 24/420
6,993,810 B2 * 2/2006 Hamada ..... A44B 19/308 24/422
7,089,632 B2 * 8/2006 Keyaki ..... A44B 19/26 24/429
7,207,092 B2 * 4/2007 Iwase ..... A44B 19/308 24/419
7,356,887 B2 * 4/2008 Iwase ..... A44B 19/306 24/415
7,404,240 B2 * 7/2008 Nedbal ..... A44B 19/262 24/415
7,565,722 B2 * 7/2009 Kusayama ..... A44B 19/386 24/388
7,694,396 B2 * 4/2010 Ogura ..... A44B 19/382 24/433
8,813,318 B2 * 8/2014 Sato ..... A44B 19/28 24/427
8,844,101 B2 * 9/2014 Nozaki ..... A44B 19/382 24/386
9,254,020 B2 * 2/2016 Miyazaki ..... A44B 19/308
2009/0260197 A1 10/2009 Keyaki et al.
2018/0027930 A1 2/2018 Hsu et al.

FOREIGN PATENT DOCUMENTS

WO 2016-135897 A1 9/2016
WO 2016/135897 A1 9/2016

OTHER PUBLICATIONS

Office Action, Korean Patent Application No. 20-2018-0002628, dated Aug. 28, 2019.

* cited by examiner

SLIDER FOR SLIDE FASTENER

REFERENCE TO RELATED APPLICATION

This application claims the benefit of Chinese Utility Model Application No. 201720701062.4 filed on Jun. 16, 2017, which is incorporated herein by reference in its entirety.

TECHNICAL FIELD

The present invention relates to a slider for a slide fastener.

BACKGROUND

A slider for a concealed slide fastener used, for example, in seats of vehicles or trains is disclosed in Patent Document 1. In the slider, a pull-tab is connected to a slider body portion via a pull-tab attachment portion.

Also, a slider for a slide fastener, in which a pull-tab made of resin is attached on a slider body portion via a pull-tab attachment portion made of a metal, is disclosed in Patent Document 2.

Patent Document 1: Japanese Patent Application Publication No. 2007-54176

Patent Document 2: WO 2016/135897

In the slider 100 of Patent Document 1, the pull-tab 107 is pivotally supported on the pull-tab attachment portion 106 via an annular portion 107a. However, the slider 100 of Patent Document 1 is not configured such that the pull-tab 107 maintains its own posture.

Also, in the slider 100 of the patent Document 2, the slider body portion 120 and the pull-tab attachment portion 160 are both made of metal and the pull-tab 200 is made of resin. The pull-tab 200 is pivotally supported on the pull-tab attachment portion 160. The pull-tab 200 has a shaft portion 210 formed of resin, and as the shaft portion 210 is in close contact with an inner circumferential surface of the pull-tab attachment portion 160, the pull-tab can maintain its own posture at a plurality of positions. However, in the slider 100 of the patent Document 2, as described above, the slider body portion 120 and the pull-tab attachment portion 160 are both made of metal, whereas the pull-tab 200 is made of resin. Therefore, in the case of the pull-tab, which is configured to be capable of maintaining its own posture, there is a need for imparting a luxury feeling to the pull-tab.

SUMMARY

It is therefore an object of the present invention to provide a slider for a slide fastener, which has a pull-tab capable of maintaining its own posture and also having a luxury feeling.

According to an aspect of the embodiments of the present invention, there is provided a slider for a slide fastener, comprising: a slider body portion; a pull-tab attachment portion provided on the slider body portion; and a pull-tab attached on the pull-tab attachment portion, wherein the pull-tab has a handle portion and a connection portion connected to the pull-tab attachment portion, wherein the connection portion comprises a shaft portion and a pair of rod portions made of metal and extending from both ends of the shaft portion toward the handle portion, wherein the shaft portion has a core portion made of metal and a resin portion made of resin and covering at least a part of a circumference of the core portion, and wherein at least a part of an outer circumferential surface of the resin portion is in contact with an inner circumferential surface of the pull-tab attachment portion.

In the slider for the slide fastener, in a width direction of the slider, a width dimension of the resin portion may be equal to or smaller than a width dimension of the pull-tab attachment portion.

In the slider for the slide fastener, the connection portion may be provided with an opening portion formed by the shaft portion, the pair of rod portions and the handle portion and configured to allow the pull-tab attachment portion to be inserted therethrough, and in a width direction of the slider, a width dimension of the opening portion may be greater than a width dimension of the pull-tab attachment portion.

In the slider for the slide fastener, as viewed in a sectional view perpendicular to an axial direction of the shaft portion, the outer circumferential surface of the resin portion may be in contact with the inner circumferential surface of the pull-tab attachment portion at three sites.

In the slider for the slide fastener, wherein as viewed in a sectional view perpendicular to an axial direction of the shaft portion, the core portion may be circular, and when the pull-tab is pivoted about the shaft portion, the core portion may be pivoted but the resin portion may not be pivoted.

In the slider for the slide fastener, wherein as viewed in a sectional view perpendicular to an axial direction of the shaft portion, the core portion may have any one shape of a + shape, a − shape, a T-shape, polygonal shapes, an elliptical shape and a star shape, and when the pull-tab is pivoted about the shaft portion, the core portion and the resin portion may be integrally pivoted.

According to the present invention, it is possible to provide a slider for a slide fastener, which has a pull-tab capable of maintaining its own posture and also having a luxury feeling.

DETAILED DESCRIPTION

Hereinafter, a slider for a slide fastener according to embodiments of the present invention will be described with reference to FIGS. 1 to 13. Meanwhile, the present invention is not limited at all to embodiments as described below, but various modifications can be made thereto as long as they have substantially the same configurations as those of the present invention and also exhibit effects similar to those thereof.

Figure 1:
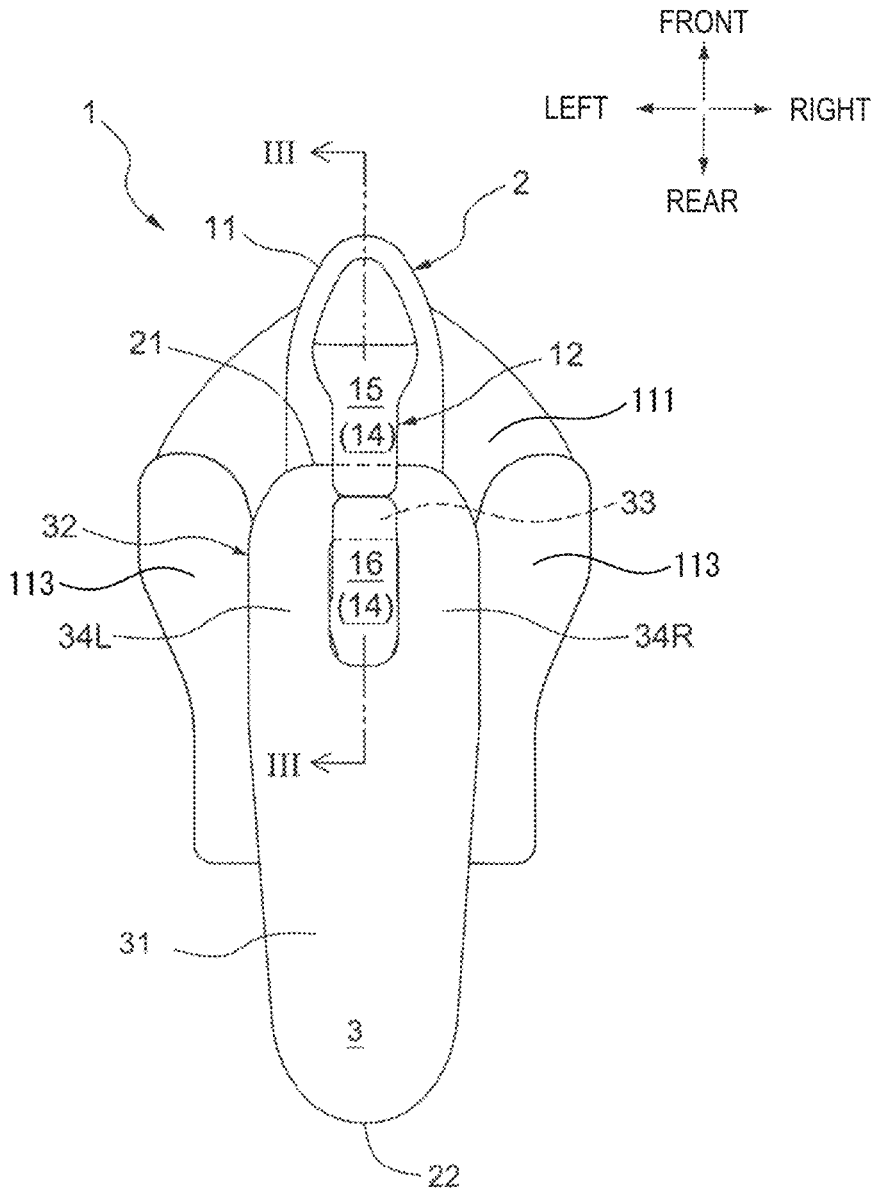
FIG. 1 is a plan view of a slider according to one embodiment of the present invention, showing a state where a pull-tab is fallen rearward.
Figure 2:
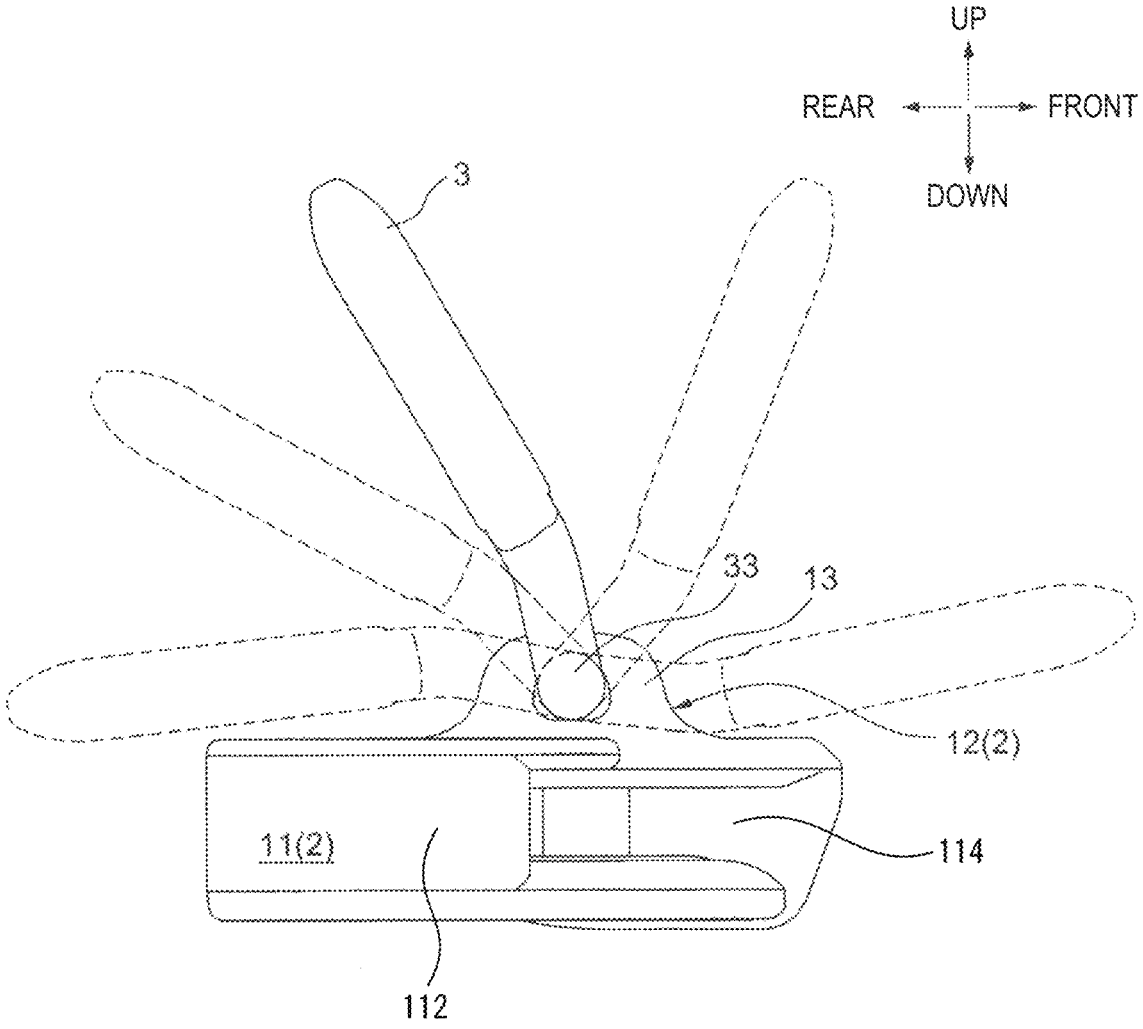
FIG. 2 is a side view showing an aspect of pivotal movement of the pull-tab of the slider according to the one embodiment of the present invention.

In the following description, as shown in FIG. 1, a front and rear direction of a slider 1 (hereinafter, also simply referred to a "front and rear direction") is a direction extending from a shoulder mouth of the slider toward a rear mouth thereof, i.e., a direction coincide with a direction along which the slider 1 is moved to open and close right and left fastener stringers (not shown). Also, a right and left direction of the slider (hereinafter, also simply referred to as a "right and left direction") is a direction perpendicular to the front and rear direction as viewed in a plan view of the slider 1. Also, as shown in FIG. 2, an upward and downward direction of the slider is a direction perpendicular to the front and rear direction and also the right and left direction. A slide fastener (not shown) includes, for example, a pair of fastener stringers and a slider. The pair of fastener stringers has fastener elements (not shown) attached in a row on each of opposing tape side edge portions of a pair of fastener tapes (not shown). In the slider, a forward movement of the slider 1 causes the right and left fastener stringers to close, thereby causing the right and left fastener elements to be engaged with each other. A rearward movement of the slider 1 causes the right and left fastener stringers to open, thereby causing the right and left fastener elements to be disengaged from each other.

The slider as shown in FIGS. 1 to 13 is a slider for a concealed slide fastener used, for example, in seats of vehicles or trains, clothes, bags and the like. But, the present invention is not limited to the slider for the concealed slide fastener. For example, the present invention may be employed in general slide fasteners. Further, the slider may be, for example, a slider including at least an upper blade, a lower blade and a connecting post for connecting a front end of the upper blade with a front end of the lower blade. This slider is illustrated, for example, in Japanese Utility Model Registration No. 3160840 or Japanese Patent Application Publication No. 2005-211200 and those skilled in the art can cause the slider to be included in the present invention by referring to the documents, and accordingly the detailed description thereof will be omitted herein.

As shown in FIG. 1, the slider 1 for a slide fastener (hereinafter, also simply referred to as "slider") has a slider main body 2 and a pull-tab 3. The slider main body 2 has a slider body portion 11 and a pull-tab attachment portion 12 provided on the slider body portion 11. The pull-tab 3 is attached on the pull-tab attachment portion 12. In the present embodiment, the slider body portion 11 and the pull-tab attachment portion 12 are both made of metal. Alternatively, the slider body portion 11 and the pull-tab attachment portion 12 may be made of, for example, resin.

The slider body portion 11 is configured to guide right and left fastener elements. Also, the slider body portion 11 is configured to engage and disengage the right and left fastener elements with and from each other while guiding the right and left fastener elements. The slider body portion 11 has a lower blade 111, a pair of right and left wall portions 112 provided on right and left side edge portions of the lower blade 111, a pair of right and left flange portions 113 extending from upper ends of the wall portions 112 inwardly in the right and left direction, and a guide post 114 provided at a side of a front end of the lower blade 111. The pull-tab attachment portion 12 is provided on an upper surface of the slider body portion 11. The pull-tab attachment portion 12 is integrally provided on the guide post 114 of the slider body portion 11, but the present invention is not necessarily limited thereto. For example, the pull-tab attachment portion 12 may be as a separate body from the slider body portion 11 and thus attached on the slider body portion 11.

Figure 3:
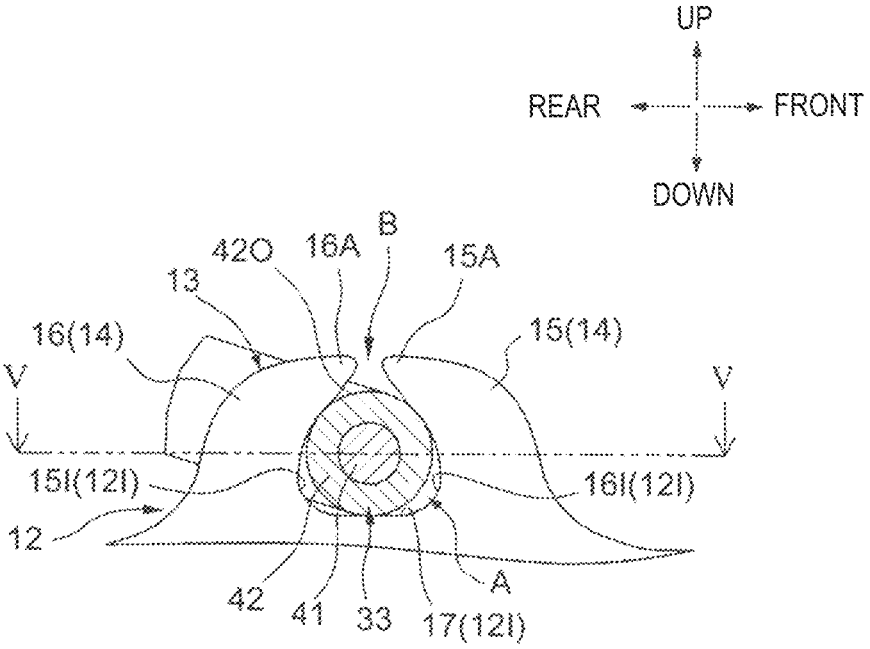
FIG. 3 is a sectional view taken along a line in FIG. 1, enlargedly showing a connection portion between a pull-tab attachment portion and the pull-tab.
Figure 13:
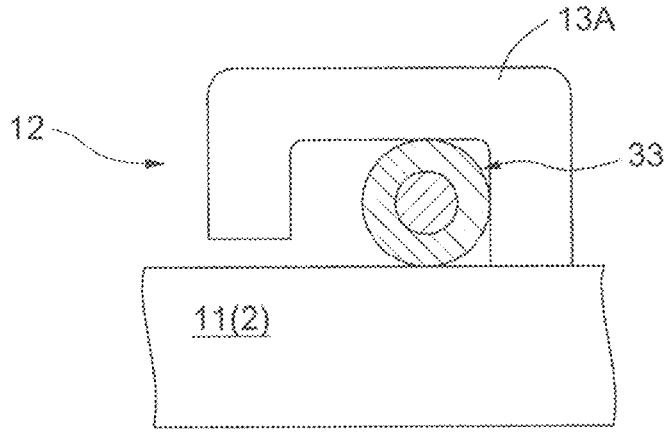
FIG. 13 is a view showing a variant of a post portion of the pull-tab attachment portion according to the present invention.

As shown in FIG. 1, the pull-tab attachment portion 12 is a member extending in the front and rear direction as viewed in a plan view. As shown in FIGS. 2, 3, 6A and 6B, the pull-tab attachment portion 12 has a post portion 13 protruding upward from the slider body portion 11 and a mount surface 17. The post portion 13 extends in the front and rear direction as viewed in a plan view. A shaft arrangement space A (see FIG. 3) configured to allow a shaft portion 33, as described below, of the pull-tab 3 to be arranged therein is formed inside the post portion 13. The post portion 13 is configured to pivotally support the shaft portion 33. As shown in FIG. 3, the post portion 13 is formed in a generally annular shape as viewed in a side view and is configured to prevent the shaft portion 33 from being removed from the pull-tab attachment portion 12. Although a case where the post portion 13 is configured in a generally annular shape as viewed in a side view by a pair of claw portions 14 as described below will be described in the present embodiment, for example, a post portion 13A, as shown in FIG. 13, formed by plastically deforming a portion, which protrudes upward from the slider body portion 11, into a generally annular shape as viewed in a side view, may be employed. Also, the post portion 13 may have any other configurations, as long as the post portion 13 can pivotally support the shaft portion 33 to prevent the shaft portion 33 from being removed from the pull-tab attachment portion 12.

As shown in FIG. 3, the pull-tab attachment portion 12 includes the post portion 13 and the mount surface 17 and is configured to pivotally support the shaft portion 33. The post portion 13 is constituted of a pair of claw portions 14. The pair of claw portions 14 are adjacent to each other with the shaft portion 33 interposed therebetween. That is, the pair of claw portions 14 are arranged on the slider body portion 11 to oppose each other. The pair of claw portions 14 are arrayed in the front and rear direction. The pair of claw portions 14 includes a front claw portion 15 arranged on a front side and a rear claw portion 16 arranged on a rear side. The shaft arrangement space A is formed between the pair of claw portions 14.

Figure 6A:
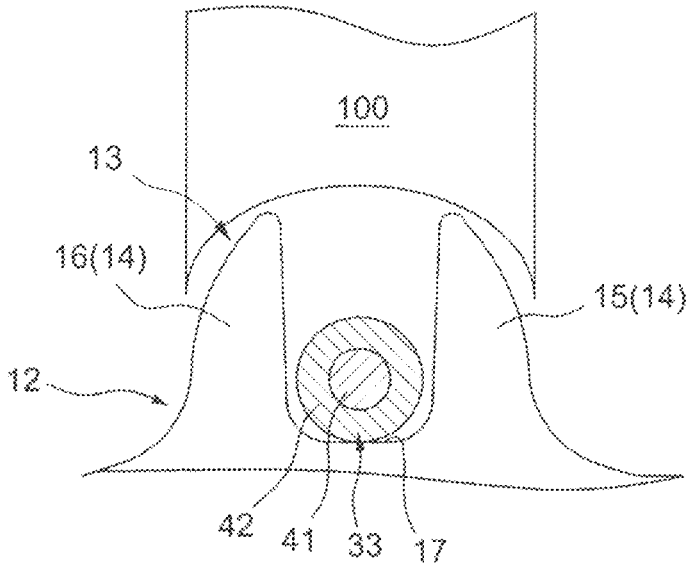
FIG. 6A schematically shows a preform before claws portion of the pull-tab attachment portion are crimped, and FIG. 6B schematically shows the slider after the claws portion are crimped.
Figure 6B:
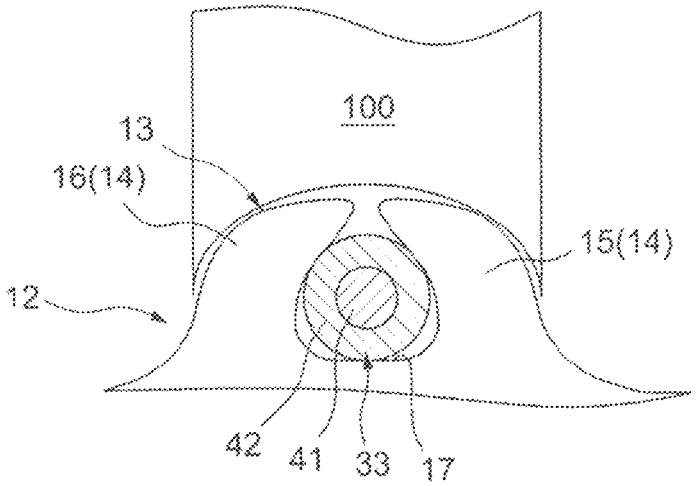

As shown in FIG. 3, each of the pair of claw portions 14 extends in a direction away from the slider body portion 11 (i.e., the upward direction) and also in a direction in which the pair of claw portions 14 approach each other. That is, the front claw portion 15 extends in an upward and rearward direction and the rear claw portion 16 extends in an upward and forward direction. More specifically, the pair of claw portions 14 extend to approach each other as the pair of claw portions 14 gradually extend toward the direction away from the slider body portion 11 (i.e., the upward direction). A width of the shaft arrangement space A in the front and rear direction becomes narrower as it goes toward the upward direction. The pull-tab attachment portion 12 is formed by crimping the pair of claw portions 14 by, for example, a punch 100 as shown in FIGS. 6A and 6B. Meanwhile, a distance between the pair of claw portions 14 before crimping as shown in FIG. 6A is substantially constant, for example, along the upward and downward direction.

Figure 4:
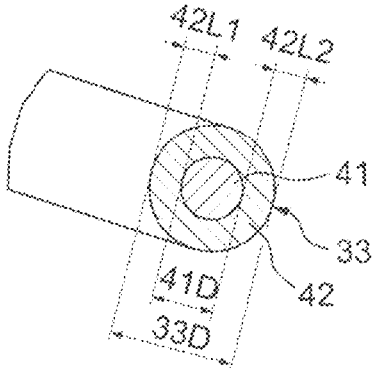
FIG. 4 is an enlarged sectional view of a shaft portion of a connection portion of the pull-tab.

As shown in FIGS. 3 and 4, a small gap B is formed between a distal end 15A of the front claw portion 15 and a distal end 16A of the rear claw portion 16. A width of the gap B in the front and rear direction is smaller than a length 33D of the shaft 33 (in the present embodiment, a diameter thereof). Also, the pull-tab attachment portion 12 has the mount surface 17 inside the post portion 13, namely, between the pair of claw portions 14. The shaft portion 33 is arranged on the mount surface 17. Typically, the mount surface 17 is a surface coincide with the upper surface of the slider body portion 11 or a surface located at a position higher than the upper surface of the slider body portion 11. The mount surface 17 is a substantially flat surface or recessed surface and is not considerably deformed during a process of crimping the claw portions 14 (plastic deformation process) as shown in FIGS. 6A and 6B.

As shown in FIG. 3, the pull-tab attachment portion 12 has an inner circumferential surface 12I therein. The inner circumferential surface 12I of the pull-tab attachment portion 12 includes an inner circumferential surface of the post portion 13 and the mount surface 17. As shown in FIG. 3, the inner circumferential surface of the post portion 13 is curved in a generally annular or generally triangular shape as viewed in a side view. In other words, the inner circumferential surface of the post portion 13 can be also referred to as inner circumferential surfaces of the pair of claw portions 14. The inner circumferential surfaces of the pair of claw portions 14 include an inner circumferential surface 151 of the front claw portion 15 and an inner circumferential surface 161 of the rear claw portion 16. The inner circumferential surfaces of the pair of claw portions 14 are curved in a direction away from the slider body portion 11 (i.e., the upward direction) and also in a direction in which the pair of claw portions 14 approach each other. That is, the inner circumferential surface 151 of the front claw portion 15 is curved in an upward and rearward direction and the inner circumferential surface 161 of the rear claw portion 16 is curved in an upward and forward direction.

Figure 7:
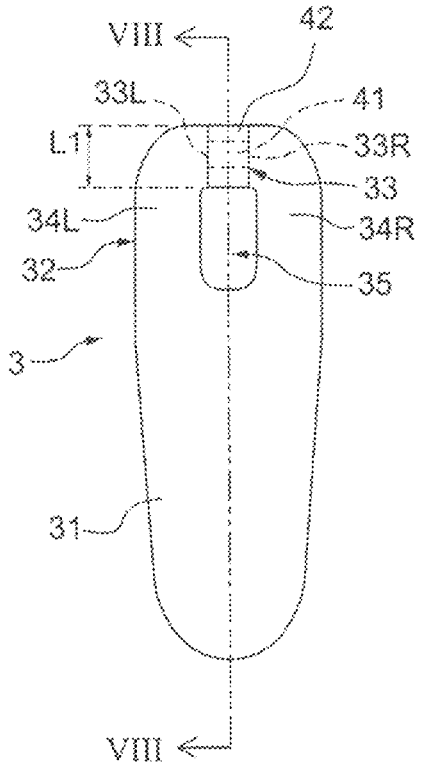
FIG. 7 is a plan view of the pull-tab.
Figure 8:
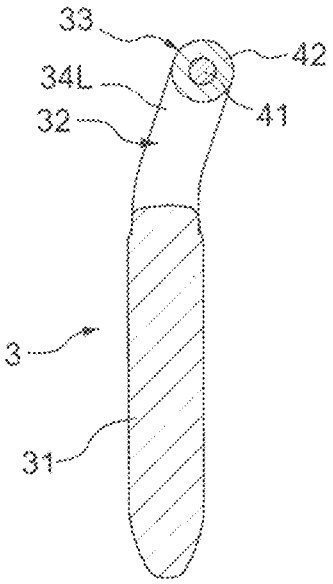
FIG. 8 is a sectional view taken along a line VIII-VIII in FIG. 7.
Figure 9:
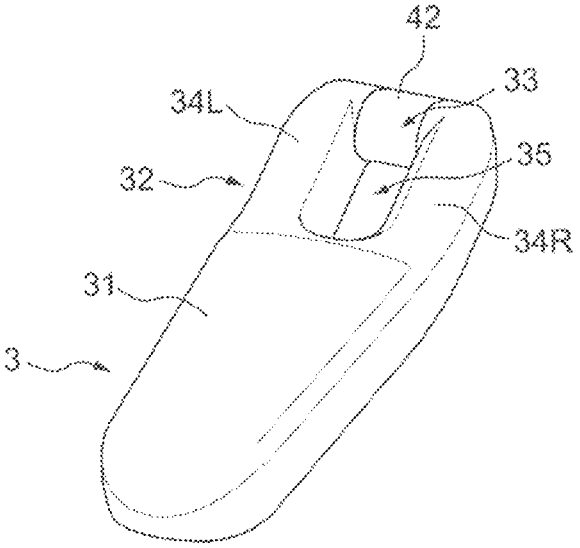
FIG. 9 is a perspective view of the pull-tab.

As shown in FIG. 1, the pull-tab 3 is an elongated member having a base end 21 and a free end 22. As shown in FIGS. 7 to 9, the pull-tab 3 has a handle portion 31 and a connection portion 32 connected to the pull-tab attachment portion 12. The connection portion 32 includes the shaft portion 33 and a pair of rod portions 34L, 34R made of metal and extending from both ends 33L, 33R of the shaft portion 33 to the handle portion 31. All of the handle portion 31 and the pair of rod portions 34L, 34R are made of metal and are formed of, for example, zinc. As shown in FIG. 2, the pull-tab 3 is configured to be pivotable about the shaft portion 33 relative to the slider body portion 11.

As shown in FIGS. 3 to 5B and 7, the shaft portion 33 extends in the right and left direction. The shaft portion 33 has a core portion 41 made of metal and a resin portion 42 made of resin and covering at least a part of a circumference of the core portion 41. The core portion 41 is formed of, for example, zinc. As shown in FIG. 7, both ends of the core portion 41 made of metal are respectively connected to the pair of rod portions 34L, 34R. The core portion 41 is formed to be thinner than the rod portions 34L, 34R. That is, the connection portion 32 is shaped such that a part thereof, on which the resin portion 42 is arranged, is cut out. Meanwhile, although the core portion 41 is one shaft connected to the pair of rod portions 34L, 34R as shown in FIG. 7, the core portion 41 made of metal may have a gap at the middle thereof and thus be configured to be divided into two right and left portions, which are respectively connected to the rod portions 34L, 35R. Further, as shown in FIG. 1 the pair of rod portions 34L, 34R extend toward the handle portion 31 to be parallel to each other, thereby extending in the front and rear direction. But, the pair of rod portions 34L, 34R may extend toward the handle portion 31 in a curved state. For example, the connection portion 32 may be generally formed in a generally annular shape by causing the pair of rod portions 34L, 35R to be curved.

Herein, the handle portion 31, the rod portions 34L, 34R and the core portion 41, which all are made of metal, are integrally formed. But, the handle portion 31 and the rod portions 34L, 34R may be separately formed. Further, the handle portion 31 may not be made of metal, but may be made of resin or made of leather, artificial leather, synthetic leather, synthetic fiber or the like. Further, the handle portion 31 may be partially made of metal and be partially made of a material, which is not metal. For example, the handle portion 31 may be one in which a cover made of a material (e.g., resin), which is not metal, is attached on an outside of a handle portion made of metal. In addition, the rod portions 34L, 34R and the core portion 41 may be separately formed.

As shown in FIG. 4, the resin portion 42 covers the entire circumference of the core portion 41 as viewed in a sectional view perpendicular to an axial direction (right and left direction) of the shaft portion 33. In the example shown in FIGS. 3 and 4, the core portion 41 has a circular post shape. But, as viewed in the above sectional view, the resin portion 42 may cover only a part of the circumference of the core portion 41. In this case, as viewed in the above sectional view, the resin portion 42 preferably cover half or more of the circumference of the core portion 41 (180° or more, in the circular shape as in the embodiment), more preferably ¾ or more thereof (270° or more, in the circular shape as in the embodiment).

The resin portion 42 is formed by a resilient member, such as POM (polyacetal or polyoxymethylene) or TPU (thermoplastic polyurethane), i.e., a flexible member. Thus, the resin portion 42 can realize a continuous interference with the pull-tab attachment portion 12 due to flexibility thereof. As shown in FIG. 4, the resin portion 42 is formed, for example, in a circular barrel shape. At least a part of an outer circumferential surface 42O of the resin portion 42 is configured to come in contact with the inner circumferential surface 12I of the pull-tab attachment portion 12. The outer circumferential surface 42O of the resin portion 42 is configured to be pressed against the inner circumferential surface 12I of the pull-tab attachment portion 12 and thus to be elastically deformed, thereby coming in close contact with the inner circumferential surface 12I of the pull-tab attachment portion 12. As a result, for example, as shown in FIG. 2, the pull-tab 3 is configured to maintain its own posture at a plurality of positions.

For example, FIG. 2 shows that the pull-tab 3 maintains its own posture at five positions in total, including a state where the pull-tab 3 is fallen forward as shown by a dotted line; a state where the pull-tab 3 is fallen rearward as shown by a dotted line; a state where the pull-tab 3 is erected as shown by a solid line; a state where the pull-tab 3 is obliquely inclined forward as shown by a dotted line; and a state where the pull-tab 3 is obliquely inclined rearward as shown by a dotted line. The pull-tab 3 can maintain its own posture over the enter range, within which the pull-tab 3 can be pivoted. But, the number of positions, in which the pull-tab 3 can maintain its own posture, can be finite, such as 4 or less positions or 6 or more positions.

The resin portion 42 may be made of any materials, other than POM (polyacetal or polyoxymethylene) or TPU (thermoplastic polyurethane), as long as the pull-tab 3 comes in contact with the inner circumferential surface 12I of the pull-tab attachment portion 12 so that the pull-tab 3 can maintain its own posture. For the pull-tab 3, various plastic materials or rubber materials having resilience and flexibility may be employed.

Figure 5A:
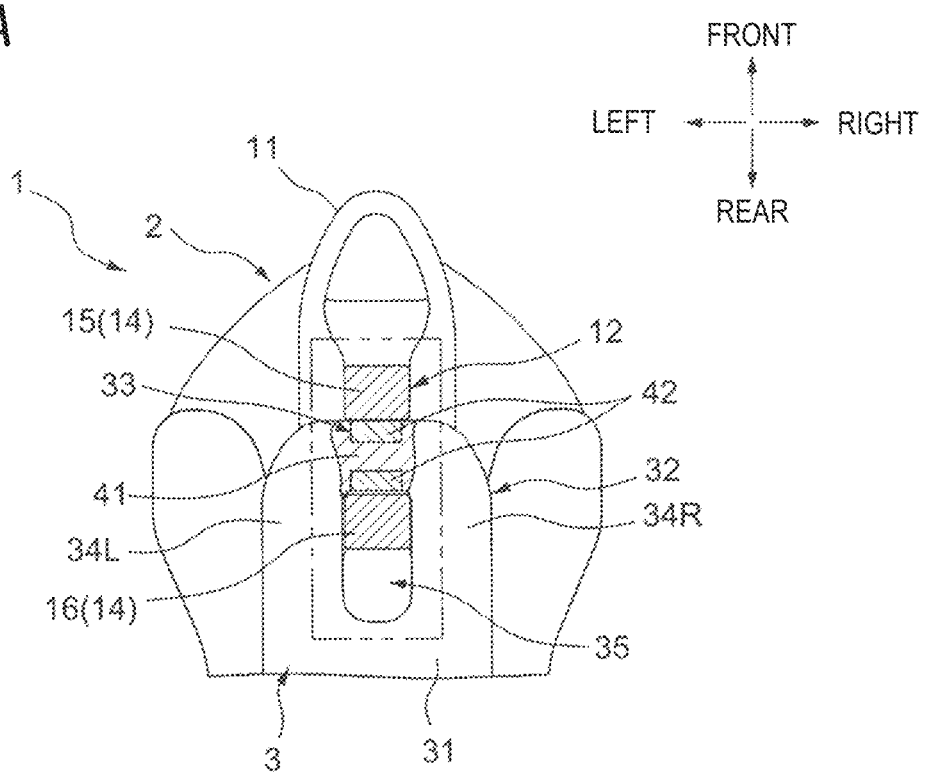
FIG. 5A is a sectional view taken along a line V-V in FIG. 3
Figure 5B:
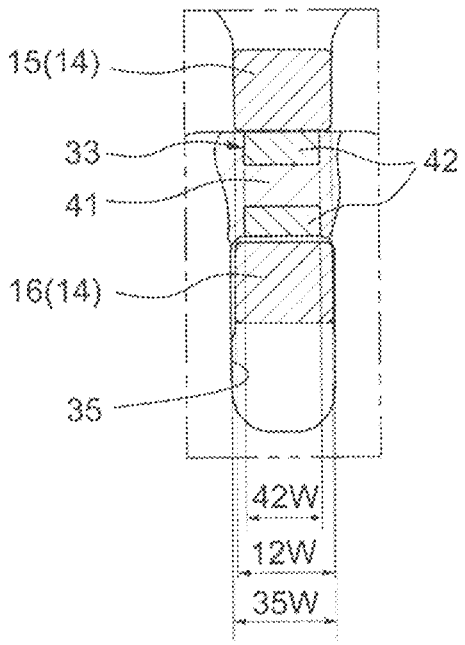
FIG. 5B is a partially enlarged view of FIG. 5A.

As shown in FIG. 5B, a width dimension 42W of the resin portion 42 in a width direction of the slider 1 is equal to or smaller than a width dimension 12W of the pull-tab attachment portion 12. That is, the width dimension 42W of the resin portion 42 is equal to or smaller than a width dimension of the pair of claw portions 14. Also, in the width direction of the slider 1, a left end (one end) of the resin portion 42 is positioned at the same location as or more right than a left end (one end) of the pull-tab attachment portion 12, and a right end (the other end) of the resin portion 42 is positioned at the same location as or more left than a right end (the other end) of the pull-tab attachment portion 12. Therefore, as shown in FIG. 1, the resin portion 42 is concealed behind the pull-tab attachment portion 12 as viewed in a plan view, so that most of the resin portion 42 is not visible to a user. But, in the width direction of the slider 1, the width dimension 42W of the resin portion 42 may be greater than the width dimension 12W of the pull-tab attachment portion 12. Similarly, a width dimension of the core portion 41 in the width direction of the slider 1 is also equal to or smaller than the width dimension 12W of the pull-tab attachment portion 12. In the present embodiment, the width dimension of the core portion 41 and the width dimension 42W of the resin portion 42 are substantially the same. But, the width dimension 42W of the resin portion 42 may be smaller than the width dimension of the core portion 41. Also, the width dimension of the core portion 41 may be greater than the width dimension 12W of the pull-tab attachment portion 12.

As shown in FIG. 4, a length of the resin portion 42 (the sum of lengths of 42L1 and 42L2) is greater than a length 41D (a diameter) of the core portion 41 as viewed in a sectional view perpendicular to the axial direction (right and left direction) of the shaft portion 33. Thus, it is possible to enhance resilience or flexibility of the resin portion 42. But, the length of the resin portion 42 may be smaller than the length 41D of the core portion 41.

Meanwhile, as shown in FIG. 7, a length (diameter), in the front and rear direction, of the shaft portion 33 is substantially the same as a length, in the front and rear direction, of the rod portions 34L, 34R adjacent to the shaft portion 33 (see a reference numeral L1 in FIG. 7). But, the length (diameter), in the front and rear direction, of the shaft portion 33 may be longer or shorter than the length, in the front and rear direction, of the rod portions 34L, 34R adjacent to the shaft portion 33.

As shown in FIG. 3, the outer circumferential surface 42O of the resin portion 42 is in contact with the inner circumferential surface 12I of the pull-tab attachment portion 12. Preferably, the outer circumferential surface 42O of the resin portion 42 is in contact with the inner circumferential surface of the post portion 13 (i.e., the inner circumferential surfaces of the claw portions 14). Also, specifically, as viewed in a sectional view perpendicular to the axial direction of the shaft portion 33, the outer circumferential surface 42O of the resin portion 42 is in contact with the inner circumferential surface 12I of the pull-tab attachment portion 12 at three sites. Preferably, the outer circumferential surface 42O of the resin portion 42 is in contact with two sites on the inner circumferential surface of the post portion 13 and also with the mount surface 17. More preferably, the outer circumferential surface 42O of the resin portion 42 is in contact with three sites, including the inner circumferential surface 151 of the front claw portion 15, the inner circumferential surface 161 of the rear claw portion 16 and the mount surface 17. But, the outer circumferential surface 42O of the resin portion 42 may be in contact with the inner circumferential surface 12I of the pull-tab attachment portion 12 at two sites or four or more sites, and also substantially the entire circumference of the outer circumferential surface 42O of the resin portion 42 may be in contact with the inner circumferential surface 12I of the pull-tab attachment portion 12.

As shown in FIG. 5B, the connection portion 32 is provided with an opening portion 35 formed by the shaft portion 33, the pair of rod portions 34L, 34R and the handle portion 31 and configured to allow the pull-tab attachment portion 12 to be inserted therethrough. As shown in FIG. 7, the opening portion 35 has a generally quadrangular shape, and for example, a length thereof in the right and left direction is wider than a width dimension 35W thereof in the right and left direction. In the width direction of the slider 1, the width dimension 35W of the opening portion 35 is greater than the width dimension 12W of the pull-tab attachment portion 12. Specifically, the front claw portion 15 of the pull-tab attachment portion 12 is inserted through the opening portion 35. In the width direction of the slider 1, the width dimension 35W of the opening portion 35 is greater than a width dimension of the front claw portion 15. But, in the width direction of the slider 1, the width dimension 35W of the opening portion 35 may be equal to or smaller than the width dimension 12W of the pull-tab attachment portion 12.

The slider 1 is configured such that the core portion 41 is circular as viewed in the sectional view perpendicular to the axial direction of the shaft portion 33 and also when the pull-tab 3 is pivoted about the shaft portion 33, the core portion 41 is pivoted but the resin portion 42 is not pivoted. In the present embodiment, for example, selecting a material for the resin portion or setting a crimping force upon crimping is performed in such a manner that a frictional force between an outer circumferential surface of the core portion 41 and an inner circumferential surface of the resin portion 42 is smaller than a frictional force between the outer circumferential surface 42O of the resin portion 42 and the inner circumferential surface 12I of the pull-tab attachment portion 12 (i.e., the inner circumferential surface of the post portion 13). Thus, when the pull-tab 3 is pivoted about the shaft portion 33, the core portion 41 of the shaft portion 33 is pivoted, but the resin portion 42 is not pivoted. In addition, due to the frictional force between the outer circumferential surface of the core portion 41 and the inner circumferential surface of the resin portion 42 of the shaft portion 33, the pull-tab 3 can maintain its own posture.

Hereinafter, a method of manufacturing the slider 1 will be described. The resin portion 42 of the pull-tab 3 can be manufactured by, for example, injection molding. That is, by injecting resin onto the whole or a part of the outer circumferential surface of the core portion 41 made of metal, the resin portion 42 made of resin and covering at least a part of the circumference of the core portion 41 is formed. But, the resin portion 42 of the pull-tab 3 may not be manufactured by injecting resin, and thus a resin portion 42 constituted of one part (e.g., a C-type resin portion 42) or a resin portion 42 constituted of a plurality of parts, which is separately formed, may be attached on the core portion 41.

For example, the resin portion 42 may be formed by previously forming two parts for the resin portion 42, which can be engaged with each other and in which the core portion 41 can be built, using resin and then by engaging the two parts with each other to sandwich the core portion 41 during a post process. Meanwhile, as described above, even if the core portion 41 made of metal has a gap at the middle thereof and thus is divided into two right and left portions, which are respectively connected to the rod portions 34L, 34R, the resin portion 42 may be formed on the whole or a part of outer circumferential surfaces of the two right and left portions by the above injection molding, or the resin portion 42 may be formed by engaging two parts, which are previously formed, with each other to sandwich the two right and left portion of the core portion 41.

In the method of manufacturing the slider 1 according to the present invention, the slider main body 2 having the pull-tab attachment portion 12 to be crimped, hereinafter referred to as a preform is manufactured by die-casting. As shown in FIG. 6A, the pull-tab attachment portion 12 of the preform is crimped by a crimping tool, for example, a punch 100, thereby attaching the pull-tab 3 on the slider main body 2.

As shown in FIG. 6A, the shaft portion 33 of the pull-tab 3 is arranged inside the post portion 13 of the pull-tab attachment portion 12, i.e., between the pair of claw portions 14 before crimping the preform. Then, the punch 100 is propelled downward and thus the post portion 13 is struck and plastically deformed by the punch 100. A degree of plastic deformation of the post portion 13 can be adjusted by a crimping force of the punch 100. A punching surface of the punch 100 includes a semi-cylindrical concave surface elongated in the axial direction, and as a result, the post portion 13, i.e., the pair of claw portions 14 is deformed along the arcuate concave surface.

During the process of crimping the claw portions, it is expected that a width of the claw portions in the right and left direction is slightly changed. That is, a width of the distal end of the claw portions in the right and left direction after crimping is wider than a width of the distal ends of the claw portions before crimping. Preferably, based on this context, dimensions of the claw portions of the preform is set.

After crimping of the claw portions, the shaft portion 33 of the pull-tab 3 is held at at least three sites by the slider main body 2 as viewed in the sectional view perpendicular to the axial direction of the shaft portion 33. That is, the shaft portion 33 is in contact with the front claw portion 15, the rear claw portion 16 and the mount surface 17 and also pressed thereagainst at contact sites therewith. Depending on the cimping force of the punch 100, a frictional force between the outer circumferential surface 42O of the resin portion 42 and the inner circumferential surface 12I of the pull-tab attachment portion 12 (i.e., the inner circumferential surface of the post portion 13) is varied. Thus, an extent of plastic deformation of the post portion 13 is determined based on maneuverability of the pull-tab 3 and also on that the pull-tab 3 can continuously maintain its own posture.

(Effects of the Present Embodiment)

The slider 1 for a slide fastener according to the present embodiment is configured such that the shaft portion 33 of the connection portion 32 of the pull-tab 3 has the core portion 41 made of metal and the resin portion 42 made of resin and covering at least a part of the circumference of the core portion 41. Also, at least a part of the outer circumferential surface 42O of the resin portion 42 is in contact with the inner circumferential surface 12I of the pull-tab attachment portion 12. Thus, the outer circumferential surface 42O of the resin portion 42 is in close contact with the inner circumferential surface 12I of the pull-tab attachment portion 12, thereby allowing the pull-tab 3 to maintain its own posture. In addition, the pair of rod portions 34L, 34R of the connection portion 32 of the pull-tab 3, which extend from both ends 33L, 33R of the shaft portion 33 to the handle portion 31, are made of metal. Thus, the connection portion 32 of the pull-tab 32 has a metallic appearance, thereby imparting a luxury feeling to the pull-tab 3. Due to the above configuration, it is possible to provide a slider for a slide fastener, which has a pull-tab capable of maintaining its own posture and also having a luxury feeling.

Also, the slider 1 for a slide fastener according to the present embodiment is configured such that in the width direction of the slider 1, the width dimension 42W of the resin portion 42 is equal to or smaller than the width dimension 12W of the pull-tab attachment portion 12. Thus, the resin portion 42 is concealed behind the pull-tab attachment portion 12. As a result, most of the resin portion 42 is not visible to a user, thereby imparting a luxury feeling to the pull-tab 3.

Also, the rod portions 34L, 34R of the connection portion 32 of the pull-tab 3 are formed of metal. Therefore, if the rod portions 34L, 34R collide with the pull-tab attachment portion 12, the rod portions 34L, 34R are likely to be bitten by the pull-tab attachment portion 12 so that the pull-tab 3 cannot be moved, or the pull-tab attachment portion 12 is likely to be damaged. However, the slider 1 for a slide fastener according to the present embodiment is configured such that in the width direction of the slider 1, the width dimension 35W of the opening portion 35 of the pull-tab 3 is greater than the width dimension 12W of the pull-tab attachment portion 12. Therefore, it is possible to inhibit the rod portions 34L, 34R from being bitten by the pull-tab attachment portion 12 so that the pull-tab 3 cannot be moved, or also to inhibit the pull-tab attachment portion 12 from being damaged.

Further, the slider 1 for a slide fastener according to the present embodiment is configured such that the outer circumferential surface 42O of the resin portion 42 is in contact with the inner circumferential surface 12I of the pull-tab attachment portion 12 at three sites. Thus, the pull-tab 3 can more stably maintain its own posture.

Further, the slider 1 for a slide fastener according to the present embodiment is configured such that the core portion 41 is circular as viewed in the sectional view perpendicular to the axial direction of the shaft portion 33 and also when the pull-tab 3 is pivoted about the shaft portion 33, the core portion 41 is pivoted but the resin portion 42 is not pivoted. Thus, in the case of the pull-tab 3 in which the core portion 41 is pivoted but the resin portion 42 is not pivoted, it is possible to provide a slider for a slide fastener, which has a pull-tab capable of maintaining its own posture and also having a luxury feeling.

Although in the foregoing, the embodiment of the present invention has been described based on the drawings, the detailed configurations are limited to the embodiment. The scope of the present invention is not defined by the description of the foregoing embodiment but by the appended claims, and also intended to encompass all changes within the meaning and scope equivalent to the claims.

(Variant 1)

Figure 10:
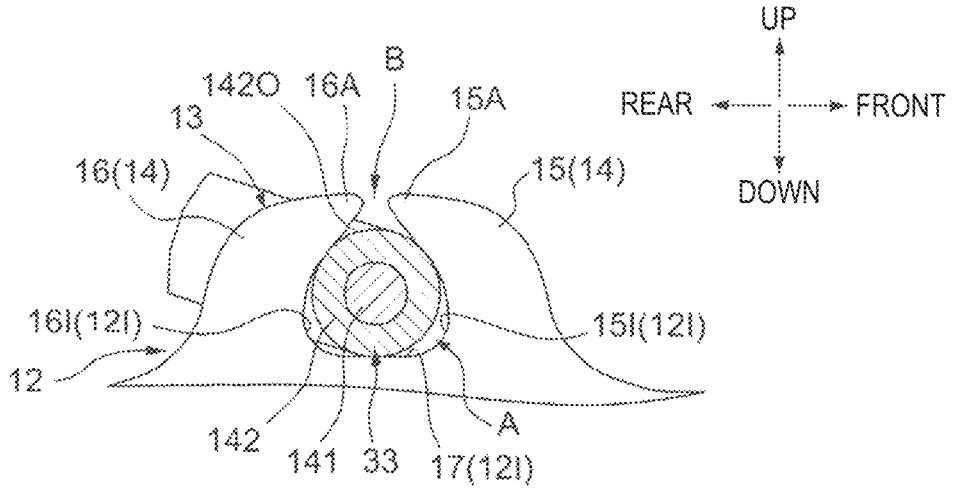
FIG. 10 is an enlarged view of a slider according to a first variant of the present invention, corresponding to FIG. 3.

FIG. 10 shows a part of a slider according to a variant 1. In the slider 1 of the foregoing embodiment, when the pull-tab 3 is pivoted about the shaft portion 33, the core portion 41 is pivoted but the resin portion 42 is not pivoted. However, the present variant 1 is different from the foregoing embodiment in that when the pull-tab 3 is pivoted about the shaft portion 33, a core portion 141 and a resin portion 142 are integrally pivoted. That is, for example, selecting a material for the resin portion or setting a crimping force upon crimping is performed in such a manner that a frictional force between an outer circumferential surface of the core portion 141 and an inner circumferential surface of the resin portion 142 is greater than a frictional force between an outer circumferential surface 142O of the resin portion 142 and the inner circumferential surface 12I of the pull-tab attachment portion 12 (i.e., the inner circumferential surface of the post portion 13). Thus, when the pull-tab 3 is pivoted about the shaft portion 33, the core portion 141 and the resin portion 142 of the shaft portion 33 are pivoted. In addition, due to the frictional force between the outer circumferential surface 142O of the resin portion 142 of the shaft portion 33 and the inner circumferential surface 12I of the pull-tab attachment portion 12 (i.e., the inner circumferential surface of the post portion 13), the pull-tab 3 can maintain its own posture. Meanwhile, the core portion 141 and the resin portion 142 have the same shapes as those of the core portion 41 and the resin portion 42 of the foregoing embodiment, and only magnitudes of the frictional forces therebetween are different from each other.

The slider for a slide fastener according to the present variant 1 is configured such that when the pull-tab 3 is pivoted about the shaft portion 33, the core portion 141 and the resin portion 142 are integrally pivoted. Thus, in the case of the pull-tab 3 in which the core portion 141 and the resin portion 142 are integrally pivoted, it is possible to provide a slider for a slide fastener, which has a pull-tab capable of maintaining its own posture and also having a luxury feeling.

(Variant 2)

Figure 11:
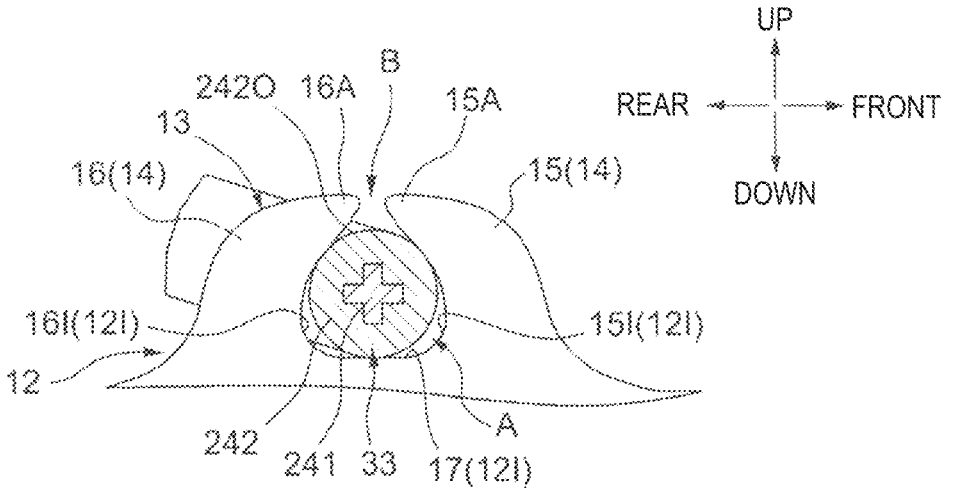
FIG. 11 is an enlarged view of a slider according to a second variant of the present invention, corresponding to FIG. 3.

FIG. 11 shows a part of a slider according to a variant 2. In the slider 1 of the foregoing embodiment, the core portion 41 has a circular post shape. That is, the core portion 41 is circular as viewed in the sectional view perpendicular to the axial direction (right and left direction) of the shaft portion 33. However, in the present variant 2, a core portion 241 has a shape other than a circle as viewed in the sectional view perpendicular to the axial direction (right and left direction) of the shaft portion 33. As shown in FIG. 11, the core portion 241 has a + (plus) shape. Like the foregoing embodiment, the present variant 2 is configured such that when the pull-tab 3 is pivoted about the shaft portion 33, the core portion 241 and the resin portion 242 are integrally pivoted. That is, when the pull-tab 3 is pivoted about the shaft portion 33, the resin portion 242 is pivoted by receiving a force from the core portion 241. In addition, due to a friction between an outer circumferential surface 2420 of the resin portion 242 of the shaft portion 33 and the inner circumferential surface 12I of the pull-tab attachment portion 12 (i.e., the inner circumferential surface of the post portion 13), the pull-tab 3 can maintain its own posture. Meanwhile, the shape of the core portion 241 is not limited to the + (plus) shape, but any other shapes may be employed as long as the resin portion 242 can be pivoted by receiving a force from the core portion 241 as the core portion 241 is pivoted. For example, the core portion may has any one shape of the + shape, a − (minus) shape, a T-shape, polygonal shapes such as triangle and quadrangle to octagon, an elliptical shape, and a star shape as viewed in the sectional view perpendicular to the axial direction (right and left direction) of the shaft portion 33.

(Variant 3)

Figure 12:
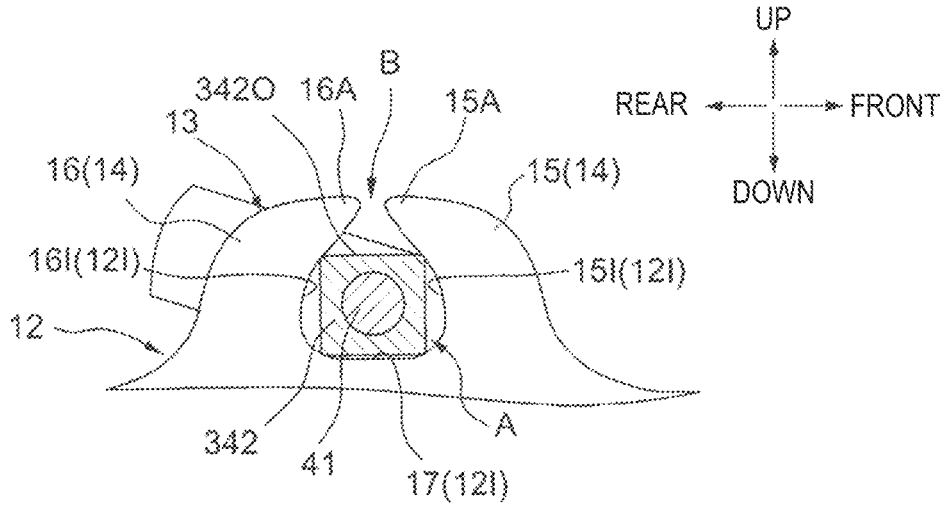
FIG. 12 is an enlarged view of a slider according to a third variant of the present invention, corresponding to FIG. 3.

FIG. 12 shows a part of a slider according to a variant 3. In the slider for a slide fastener according to the foregoing embodiment, when the pull-tab 3 is pivoted about the shaft portion 33, the core portion 41 is pivoted but the resin portion 42 is not pivoted. In the slider 1 of the foregoing embodiment, the resin portion 42 has a circular barrel shape. That is, the resin portion 42 has a circular barrel shape as viewed in the sectional view perpendicular to the axial direction (right and left direction) of the shaft portion 33. However, in the present variant 3, a resin portion 342 has a shape other than a circular barrel as viewed in the sectional view perpendicular to the axial direction (right and left direction) of the shaft portion 33. As shown in FIG. 12, the resin portion 342 has a quadrangular shape (e.g., square or rectangular). Due to this configuration, like the foregoing embodiment, the present variant 3 is configured such that when the pull-tab 3 is pivoted about the shaft portion 33, the core portion 41 is pivoted but the resin portion 342 is not pivoted. That is, a frictional force between an outer circumferential surface of the core portion 41 and an inner circumferential surface of the resin portion 342 is smaller than a force, which occurs as the inner circumferential surface 12I of the pull-tab attachment portion 12 (i.e., the inner circumferential surface of the post portion 13) blocks pivoting of the quadrangular resin portion 342, and a frictional force therebetween. Thus, when the pull-tab 3 is pivoted about the shaft portion 33, the core portion 41 of the shaft portion 33 is pivoted, but the resin portion 342 is not pivoted. In addition, due to the frictional force between the outer circumferential surface of the core portion 41 and the inner circumferential surface of the resin portion 342, the pull-tab 3 can maintain its own posture. Also, an outer circumferential surface 342O of the resin portion 342 is in contact with the inner circumferential surface 12I of the pull-tab attachment portion 12, for example, at four sites. However, the shape of the resin portion 342 is not limited to the quadrangular shape, but the resin portion 342 may have a polygonal shape, such as hexagon or octagon, as viewed in the sectional view perpendicular to the axial direction (right and left direction) of the shaft portion 33.

What is claimed is:

1. A slider for a slide fastener, comprising:

a slider body portion;

a pull-tab attachment portion provided on the slider body portion; and a pull-tab attached on the pull-tab attachment portion, wherein the pull-tab has a handle portion and a connection portion connected to the pull-tab attachment portion, wherein the connection portion comprises a shaft portion and a pair of rod portions made of metal and extending from both ends of the shaft portion toward the handle portion, wherein the shaft portion has a core portion made of metal and a resin portion made of resin and covering at least a part of a circumference of the core portion, wherein at least a part of an outer circumferential surface of the resin portion is in contact with an inner circumferential surface of the pull-tab attachment portion, and wherein in a width direction of the slider, a width dimension of the resin portion is equal to or smaller than a width dimension of the pull-tab attachment portion.

2. The slider for the slide fastener according to claim 1, wherein the connection portion is provided with an opening portion formed by the shaft portion, the pair of rod portions and the handle portion and configured to allow the pull-tab attachment portion to be inserted therethrough, and wherein in the width direction of the slider, a width dimension of the opening portion is greater than the width dimension of the pull-tab attachment portion.

3. The slider for the slide fastener according to claim 1, wherein as viewed in a sectional view perpendicular to an axial direction of the shaft portion, the outer circumferential surface of the resin portion is in contact with the inner circumferential surface of the pull-tab attachment portion at three sites.

4. A slider for a slide fastener, comprising:

a slider body portion;

a pull-tab attachment portion provided on the slider body portion; and a pull-tab attached on the pull-tab attachment portion, wherein the pull-tab has a handle portion and a connection portion connected to the pull-tab attachment portion, wherein the connection portion comprises a shaft portion and a pair of rod portions made of metal and extending from both ends of the shaft portion toward the handle portion, wherein the shaft portion has a core portion made of metal and a resin portion made of resin and covering at least a part of a circumference of the core portion, wherein at least a part of an outer circumference surface of the resin portion is in contact with an inner circumference surface of the pull-tab attachment portion, wherein as viewed in a sectional view perpendicular to an axial direction of the shaft portion, the core portion is circular, and wherein when the pull-tab is pivoted about the shaft portion, the core portion is pivoted but the resin portion is not pivoted.

5. The slider for the slide fastener according to claim 1, wherein as viewed in a sectional view perpendicular to an axial direction of the shaft portion, the core portion has a + shape, and wherein when the pull-tab is pivoted about the shaft portion, the core portion and the resin portion are integrally pivoted.

* * * * *